United States Patent [19]

Di Giusto

[11] Patent Number: 5,007,668

[45] Date of Patent: Apr. 16, 1991

[54] INTEGRATED CONTROL DEVICE FOR A VEHICLE DOOR AND DOOR FITTED WITH THIS DEVICE

[75] Inventor: Nevio Di Giusto, Venaria, Italy

[73] Assignee: Fiat Auto S.p.A., Turin, Italy

[21] Appl. No.: 531,573

[22] Filed: Jun. 1, 1990

[51] Int. Cl.[5] ..... E05C 3/26

[52] U.S. Cl. ..... 292/216; 292/337; 292/DIG. 53

[58] Field of Search ..... 292/336.3, 216, 280, 292/347, 337, 201, DIG. 53, DIG. 25

[56] References Cited

U.S. PATENT DOCUMENTS

| | | | |
|---|---|---|---|
| 4,052,094 | 10/1977 | Widen | 292/336.3 |
| 4,575,138 | 3/1986 | Nakamura et al. | 292/337 X |
| 4,603,894 | 8/1986 | Osankowski | 292/337 X |
| 4,671,548 | 6/1987 | Häberl et al. | 292/337 X |
| 4,679,836 | 7/1987 | Pupillo et al. | 292/337 X |
| 4,691,949 | 9/1987 | Granty et al. | 292/216 |
| 4,735,447 | 4/1988 | Kleefeldt | 292/216 |
| 4,945,784 | 8/1990 | Gergoe | 292/DIG. 25 X |

*Primary Examiner*—Richard E. Moore
*Attorney, Agent, or Firm*—Frost & Jacobs

[57] ABSTRACT

The invention relates to a vehicle door equipped with an integrated control device that can be mounted and tested off the assembly line; the door presents a slot for an outer handle, an inner supporting plate and a lateral clearance hole machined close to the clearance slot; the aforesaid integrated device comprises an L-shaped bracket supporting, on one wing, the outer handle and, on the other, a fork of a lock housed inside the bracket and connected to the outer handle and an inner handle fitted with its own supporting bracket and connected to the lock by means of a flexible cable; during use, the L-shaped bracket is fixed to the door with the fork facing the lateral slot and the outer handle housed inside the clearance slot and the bracket of the inner handle fixed to the inner plate of the door.

6 Claims, 2 Drawing Sheets

INTEGRATED CONTROL DEVICE FOR A VEHICLE DOOR AND DOOR FITTED WITH THIS DEVICE

BACKGROUND OF THE INVENTION

The present invention relates to a preassemblable off line integrated control device for a vehicle door, and the door as a whole, fitted with this device.

Current vehicle doors are equipped with control devices comprising separate functional elements, which are produced, tested and assembled separately on the door, sometimes at different times, and then connected to each other on the line, during the final assembly of the vehicle; in particular, these functional elements are the actual lock itself, comprising the fork and other engaging mechanisms, said lock engaging with the dog fixed to the door post, the outer handle, with the key catch and the inner handle; these handles are connected during the final stage of assembly to the lock by means of tie rods and/or other transmission devices, so as to control activation of the actual lock. However, as a result of machining and assembly tolerance limits, connection and operation problems often arise, making radical adjustments necessary on the line during or after assembly in order to ensure that the lock works correctly.

SUMMARY OF THE INVENTION

The object of the invention is to provide an integrated control device for vehicle doors that can be assembled and tested off the assembly line and that are, at the same time, easy to assemble (and disassemble, for repair purposes) on the door and extremely reliable.

According to the present invention there is provided an integrated control device for a vehicle door, of the type comprising a lock equipped with a engaging fork, an outer handle and an inner handle that activate the lock, characterized in that said outer handle and said lock are held connected to each other by an L-shaped bracket, which supports said outer handle on a first wing and said lock on a second wing, projecting laterally from the first wing and supporting on its opposite side with respect to the first wing, said grounding fork; said inner handle being held fixed and idle by a second supporting bracket and being connected to said lock by a flexible cable whose ends are securely fixed to said supporting brackets, said brackets being equipped with means of fixing to said door.

BRIEF DESCRIPTION OF THE DRAWINGS

The invention will be explained by way of example, with reference to the accompanying drawings in which.

DETAILED DESCRIPTION OF THE INVENTION

Figure 5:
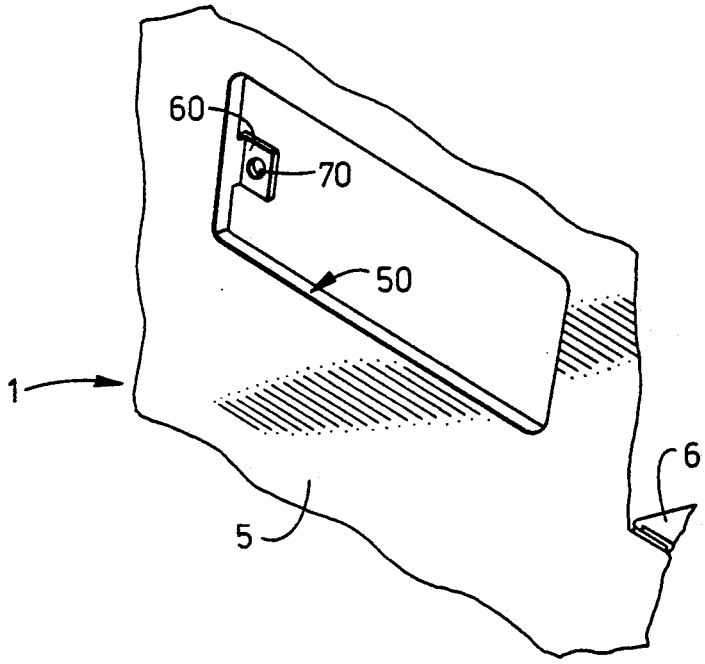
Figure 2:
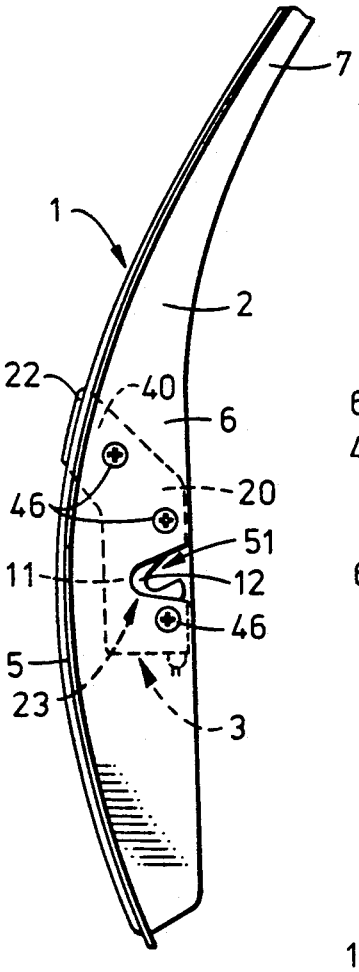
FIG. 2 is a rear side view of the door shown in FIG. 1.
Figure 1:
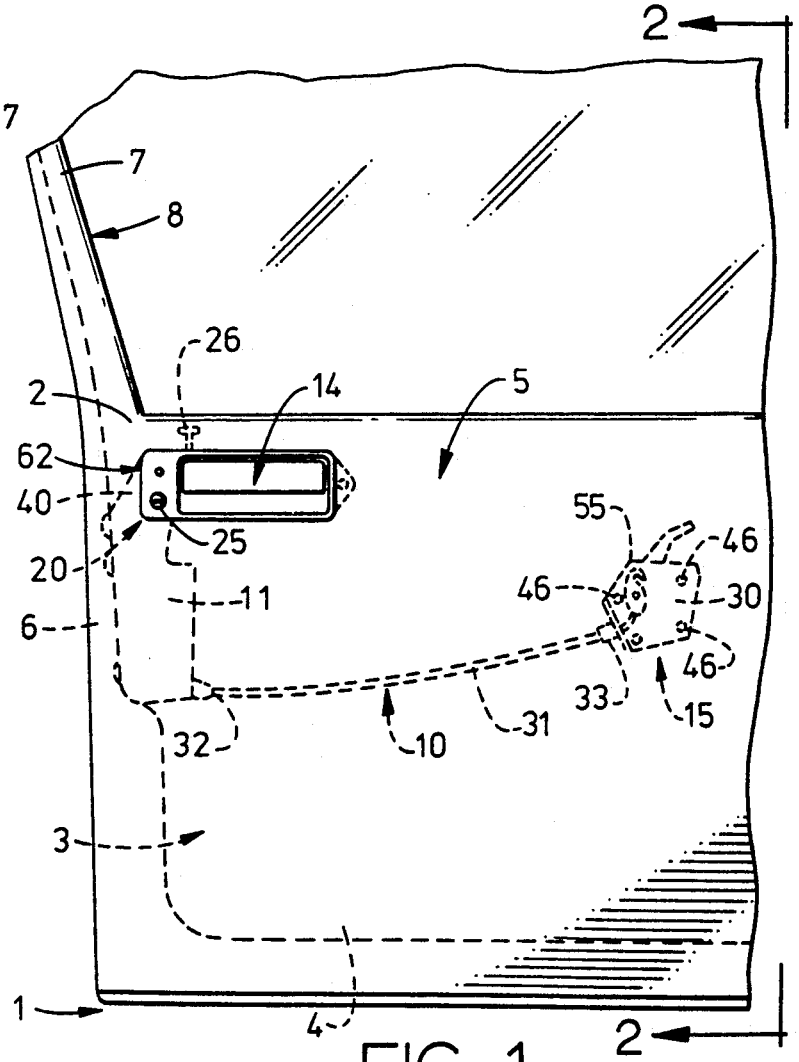
FIG. 1 shows a door equipped with the control device constituting the invention.

In reference to the aforesaid figures, the numeral 1 on the overall view indicates a door for a vehicle of any known kind, not illustrated here for the sake of simplicity: door 1, of which only the lower part is illustrated in FIGS. 1 and 2, and a detail of which is illustrated on an enlarged scale in FIG. 5, comprises a supporting structure 2 enclosing a chamber 3 and an inner finishing panel 4 which may be applied to structure 2 to close chamber 3; this is in fact bounded by an outer metal wall 5 and by respective sides or perimetral doorposts 6 and **6*a*, respectively rear and front, forming, together with a frame 7 bounding a window 8 above chamber 3, a part of supporting structure 2, against which panel 4** is fixed in a known manner not illustrated here for the sake of simplicity.

Figure 4:
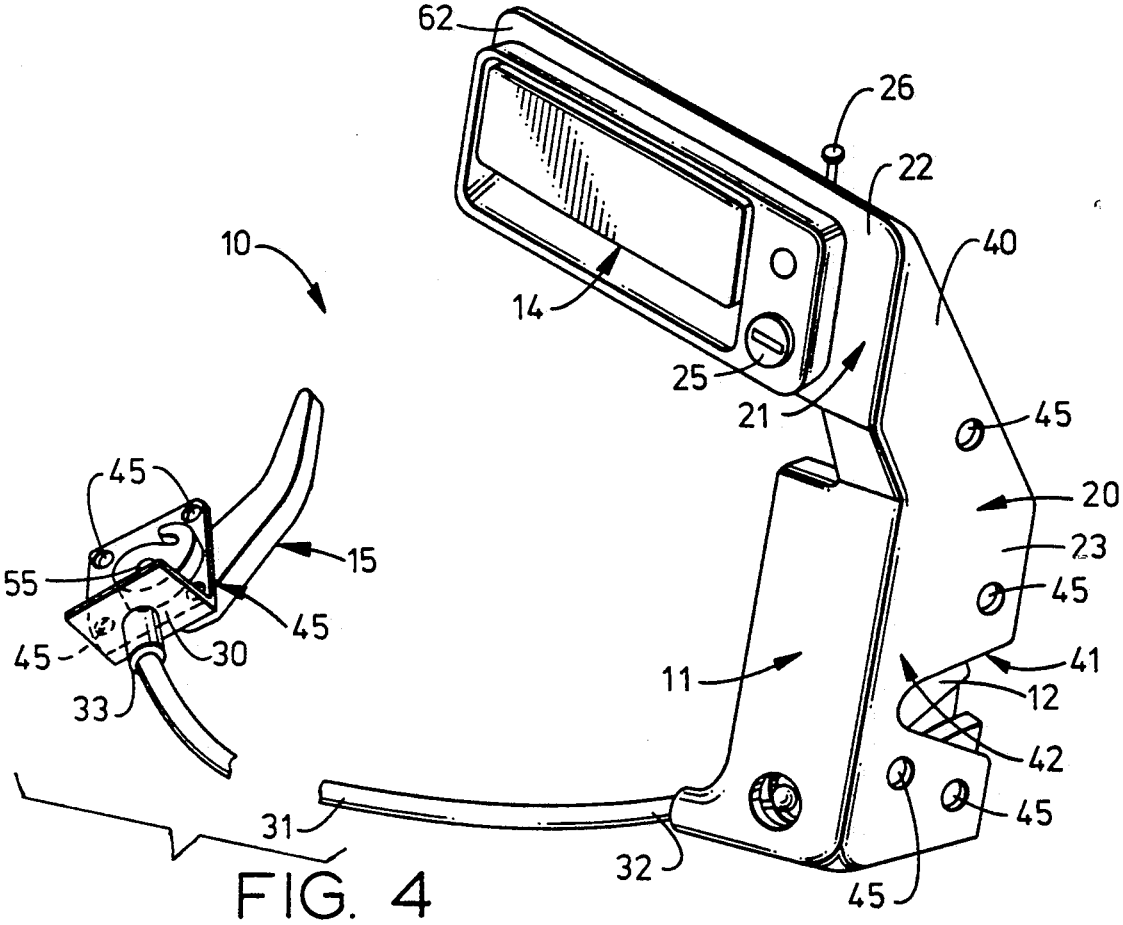
FIG. 4 is a large scale perspective view of the device in accordance with the invention.
Figure 3:
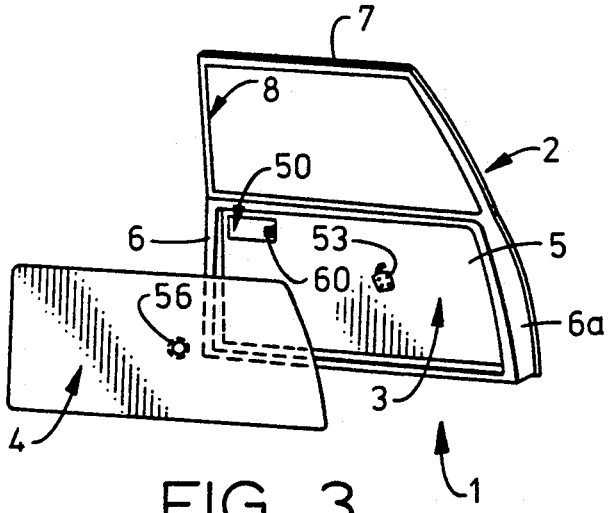
FIG. 3 is a schematic exploded view of a door produced in such a way that the device in accordance with the invention may be fitted.

Door 1 also includes a single block integrated control device 10, illustrated in detail in FIG. 4; this comprises a lock 11 of known type, fitted with a engaging fork 12, also of a known type, an outer handle 14 and an inner handle 15 for activating lock 11 connected, in a known manner not illustrated here for the sake of simplicity, to the internal mechanisms of lock 11, also known and not illustrated here for the sake of simplicity, with the exception of fork 12. In accordance with the invention, lock 11 and outer handle 14 are held securely connected to each other, in a fixed and prefixed spacial position and together with the respective control transmission means, of a known type and not illustrated for the sake of simplicity, by an L-shaped bracket 20, that supports outer handle 14 on an outer surface 21 of a first wing 22 and lock 11 on a second wing 23, projecting laterally from wing 22 and supporting on its opposite side to wing 22, engaging fork 12; in particular, bracket 20 presents a boxed structure and houses, inside wing 23, which has the form of a parallelepiped, the inner elements of lock 11, and, inside wing 22, the inner mechanisms of handle 14, and a lock catch 25 set across surface 21 beside handle 14, for example integrated in said surface, and said connecting mechanisms, of a known type and not illustrated, between handle 14 and lock 11; furthermore, wing 22 has on its top a button 26 for locking/unlocking handle 14, controlled in parallel by catch 25, or in accordance with a possible variant not illustrated for the sake of simplicity, with at least one window for access to the known mechanisms not illustrated for controlling handle 14, through which to the same mechanisms can be connected a button similar to button 26 but that can be preassembled on door 1, for example supported in a known manner by structure 2 or by finishing panel 4.

Inner handle 15 is on the contrary held fixed and idle by a second supporting bracket 30, independent of bracket 20, and is connected to lock 11, in other words to said known and not illustrated inner mechanisms of said lock, by a flexible cable or tie rod 31, ends 32 and 33 of which are securely fixed at oppostie ends of brackets 20 and 30, so that cable 31 and bracket 30, with relative handle 15, define a flexible appendix of bracket 20, but securely fixed to said bracket forming with it and with handle 14 and lock 11 held by it a single perfectly functioning functional unit constituting device 10 in accordance with the invention.

Bracket 20 is shaped so that in use wing 23 engages rear perimetral side 6 of door 1 at the same time as wing 22 engages with outer wall 5 of door 1, on the inner side of said door. In particular, bracket 20 comprises an oblique intermediate connection section between wings 22 and 23 with a form that enables wing 22 to be kept on a plane staggered forward with respect to the plane on which wing 23 lies, that is out of line with said plane towards wall 5 of door 1. Engaging fork 12 is preferably to be housed in a recess 41 open on its side and machined into a lateral surface 42 of wing 23, which is shaped to define the binder of lock 11.

Brackets 20 and 30 are fitted with means of fixing to door 1 formed, in the example illustrated, by respective clearance holes 45 housing screws 46, of a known type, of which only some are illustrated. Similarly, door 1 is shaped so as to be adapted to receive device 10 inside chamber 3; in particular, outer wall 5 is fitted, at a point immediately below window 9, with a clearance slot 50, for example rectangular in shape, housing handle 14 and machined near to a lateral compartment 51, in turn machined through rear side 6 of structure 2 on a level with engaging fork 12 in such a position that it remains, with device 10 assembled on door 1, aligned with compartment 41; fork 12 is therefore accessible from the outside through compartment 51 and can engage in use with said dog fixed to the striking post of the door compartment for door 1.

Wings 22 and 23 of bracket 20 are fixed, by means of respective screws 46, respectively to outer wall 5 and rear side 6 of structure 2, while bracket 30 supporting inner handle 15 is fixed to a supporting plate 53 held internally by outer wall 5, inside chamber 3; inner handle 15 is in turn held idle and axially removable, by bracket 15 by means of a pin 55 housed in use through a hole 56 in finishing panel 4; in particular, wing 22 enables handle 14 to be blocked in slot 50 using a single screw 46, not illustrated for the sake of simplicity; in fact, the clearance slot housing outer handle 14 is fitted, on the opposite side to the lateral compartment 51, with an L-shaped lug 60 projecting inside slot 50 and towards the inside of door 1, on a plane further back from the one on which outer wall 5 lies; one end 62 of wing 22, opposite to wing 23 is inserted during assembly between lug 601 and wall 5 and is securely fixed is a removable manner to lug 60, for example by tightening a screw 46 inside a threaded hole 70 machined through lug 60.

Figure 6:
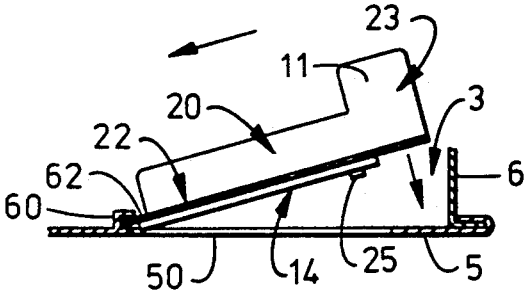
FIGS. 5 and 6 show, respectively, design and assembly details of the door and the device in accordance with the invention.

In use, device 10 is preassembled off the assembly line, assembling in a known manner known parts, such as lock 11 and handle 14 with relative gears, inner mechanisms and outer controls, on bracket 20; then handle 15 is also connected, assembled on bracket 30, by means of flexible cable 31. At this point, a perfectly functioning assembly is obtained that can be tested off the assembly line, making the necessary adjustments to compensate for any positioning errors between lock 11 and handle 14; this adjustment is hardly ever necessary however, as positioning errors are extremely unlikely to occur, the components of device 10 being assembled, according to the invention, on an element of an extremely reduced size and with a much greater rigidity than the door. Finally, the device 10 tested is put on the assembly line where it is assembled onto door 1; in particular, bracket 20 is assembled in line with slot 50 as shown by the arrows in FIG. 6, by blocking end 62 under lug 60, holding bracket 20 tilted and then turning bracket 20 about lug 60 until handle 14 moves into slot 50 and wing 23 comes opposite compartment 51; screws 46 are then tightened, thus blocking bracket 20 and then bracket 30 is assembled and fixed onto supporting plate 53, the positioning of handle 15 not entailing any problems as said handle is connected to lock 11 by a flexible cable; finally, handle 15 is removed from pin 55, panel 4 is assembled and handle 15 is reinserted on pin 55 through hole 56.

From the description set forth above, the advantages of the invention are clear; the presence of bracket 20 enables, thanks to the shape of said bracket, devices 10 of a reduced size to be obtained, that may be completely assembled and tested off the assembly line and then assembled quickly and easily on the door designed accordingly and thus may easily be automatized with robots; it is finally to be noted that all positioning errors are substantially avoided, so the reliability of the locks cannot be negatively influenced by incorrect assembly onto the door.

What is claimed is:

1. An integrated control device for a vehicle door, of the type comprising a lock equipped with an engaging fork, an outer handle and an inner handle that activate the lock, characterized in that said outer handle and said lock are held connected to each other by an L-shaped bracket, which supports said outer handle on a first wing and said lock on a second wing, projecting laterally from the first wing and supporting on its opposite side with respect to the first wing, said engaging fork; said inner handle being held fixed and idle by a second supporting bracket and being connected to said lock by a flexible cable whose ends are securely fixed to said supporting brackets, said brackets being equipped with means of fixing to said door.

2. A device as claimed in claim 1, characterized in that said L-shaped bracket has a form that enables said second wing to engage with a rear perimetral side at the same time as said first wing engages with an outer wall of the door, on the inner side of said door.

3. A device as claimed in claim 1, characterized in that said L-shaped bracket comprises an oblique intermediate connection section between said first and second wing shaped in such a way as to keep said first wing on a plane in front of the plane on which said second wing lies.

4. A device as claimed in claim 1, characterized in that said engaging fork is housed inside a recess with an open side machined on a lateral surface of said second wing.

5. A vehicle door, comprising an integrated control device as claimed in claim 1, a supporting structure, in turn comprising an outer wall bounding, together with respective perimetral sides, a chamber housing said device and a frame bounding a window above said chamber, and an inner finishing panel which may be applied to said structure to close said chamber, characterized in that said outer wall is fitted with a clearance hole housing said outer handle and machined near to a lateral compartment in turn machined through a rear side of said structure on a level with said engaging fork and through which said fork is accessible from the outside; said first and second wing of the L-shaped bracket being fixed, by means of respective screws, respectively to said outer wall and to said rear side of the structure and said supporting bracket of the inner handle being fixed to a supporting plate held internally by said outer wall of the door, the inner handle being held idle by said supporting bracket by means of a pin housed through a hole in said finishing panel.

6. A door as claimed in claim 5, characterized in that said clearance hole housing said outer handle is fitted, on the opposite side to said side compartment, with a lug projecting inside said slot and towards the inside of said door on a plane behind the plane on which said outer wall lies; an end of said first wing, opposite to said second wing, being inserted between said lug and said outer wall of the door and being securely fixed in a removable manner to said lug.

* * * * *